US006202836B1

(12) United States Patent
Picciolo

(10) Patent No.: US 6,202,836 B1
(45) **Date of Patent: *Mar. 20, 2001**

(54) FOOD AND BEVERAGE CARRIER

(76) Inventor: Frank Picciolo, 7325 14th Ave., Brooklyn, NY (US) 11228

( * ) Notice: Subject to any disclaimer, the term of this patent is extended or adjusted under 35 U.S.C. 154(b) by 0 days.

This patent is subject to a terminal disclaimer.

(21) Appl. No.: 08/892,626

(22) Filed: Jul. 14, 1997

Related U.S. Application Data

(63) Continuation-in-part of application No. 08/731,195, filed on Oct. 7, 1996, now Pat. No. 5,797,486.

(51) Int. Cl.[7] ..... B65D 75/00

(52) U.S. Cl. ..... 206/194; 206/162; 206/168; 206/427; 229/904

(58) Field of Search ..... 229/904, 902; 206/193, 194, 198, 199, 427, 162, 168, 147, 149, 151, 158, 459.5, 140

(56) References Cited

U.S. PATENT DOCUMENTS

| | | | | |
|---|---|---|---|---|
| D. 367,409 | | 2/1996 | Hunter | D7/706 |
| 2,330,699 | | 9/1943 | Flamm | 206/147 |
| 3,123,213 | | 3/1964 | Kulig | 206/158 |
| 3,140,036 | * | 7/1964 | Spery | 206/149 |
| 3,661,417 | | 5/1972 | Inman | 206/158 |
| 3,958,744 | | 5/1976 | Herglotz | 206/831 |
| 4,620,664 | | 11/1986 | Kaufman | 206/831 |
| 4,969,595 | * | 11/1990 | Teasdale | 206/459.5 |
| 5,052,552 | | 10/1991 | Maroszek | 206/427 |
| 5,320,216 | | 6/1994 | Pangborn | 206/153 |
| 5,337,947 | * | 8/1994 | Eskandry | 206/459.5 |

* cited by examiner

*Primary Examiner*—Paul T. Sewell
*Assistant Examiner*—J. Mohandesi
(74) *Attorney, Agent, or Firm*—Jean-Marc Zimmerman, Esq.

(57) ABSTRACT

A carrier for transporting food and beverage containers, having a first container support wall for supporting an upper portion of a food and beverage container, a second container support wall spaced vertically from the first wall for supporting a lower portion of a food and beverage container, wherein a plurality of apertures are disposed in the first and second walls for receiving a food and beverage container. The carrier is structurally reinforced by providing a plurality of reinforcement panels which extend between the first and second walls of the carrier, at least two of these reinforcement panels having selectively re-useable reinforcement flaps along their edges. A detachable coupon-like portion can be optionally provided in at least one the reinforcement panels.

24 Claims, 5 Drawing Sheets

FOOD AND BEVERAGE CARRIER

This application is a continuation-in-part of U.S. patent application Ser. No. 08/731,195, entitled IMPROVED FOOD AND BEVERAGE CARRIER, filed Oct. 7, 1996 by Picciolo, now U.S. Pat. No. 5,797,486 issued Aug. 25, 1998.

FIELD OF INVENTION

The present invention relates generally to disposable food and beverage container carriers and more particularly to an improved disposable food and beverage container carrier having a plurality of carrier reinforcement panels which add strength, rigidity and durability to the carrier.

BACKGROUND OF THE INVENTION

Disposable food and beverage container carriers are well known in the prior art. Such carriers are commonly used by spectators at media events like sporting events and musical concerts, to transport food and beverage containers obtained at concession stands to the spectator seating or viewing area. In addition, such carriers are also used to carry take-out food and beverage containers from fast food restaurants and delicatessens.

In order to make the use of these disposable food and beverage container carriers economically feasible, such carriers are typically manufactured from a single sheet of paper material, such as cardboard. The cardboard sheet is folded along an arrangement of predefined creases to assemble the carrier. A conventional food and beverage carrier A is shown in FIG. 1. The carrier A shown therein generally comprises a beverage container support tray B and a handle G. The container support tray B includes an upper wall C and a vertically spaced lower wall D. A plurality of circular-shaped apertures E and F are defined respectively in upper and lower walls C and D. The apertures E in the upper wall C are aligned directly over the apertures F in the lower wall D so that food and beverage containers and the like, can be placed therein and securely held in the carrier A without tilting or sliding around. The handle G extends from the outer surface of the upper wall C and includes a elongated finger opening H. The carrier A is manufactured from a single sheet of cardboard which is folded along creases I, J, K and L. The food and beverage carrier of FIG. 1 and other like carriers, all suffer from a significant drawback, namely that they are rather flimsy in construction. Consequently, when such carriers are fully loaded with filled food or beverage containers, the carriers tend to collapse, tear, or fall apart. On some occasions the fully loaded carrier will collapse, tear, or fall apart to such a degree as to allow one or more of the filled containers to fall through the container apertures of the carrier.

It is, therefore, an object of the present invention to provide an improved food and beverage container carrier which is more rigid and therefore, stronger than conventional prior art food and beverage container carriers, in order to insure that filled food or beverages containers can be transported without accidental spillage. It is also an object of the present invention to provide a food and beverage carrier having detachable coupon-like panels.

SUMMARY OF THE INVENTION

An improved carrier for transporting food and beverage containers, comprising a first container support wall for supporting an upper portion of a food and beverage container, a second container support wall for supporting a lower portion of a food and beverage container, and a plurality of reinforcement panels extending between the first and second container support walls for rigidifying the carrier, each of the reinforcement panels defining a pair of opposing edges, wherein at least one of the reinforcement panels is coupled to a reinforcement tab that has a side surface which is adhesively coupled to the interior of one of the first and second container support walls.

In one embodiment of the carrier of the present invention, at least one aperture includes gripping means for gripping the container.

In another embodiment of the carrier of the present invention, the carrier further comprises selectively re-useable reinforcement flaps extending along the edges of two of the plurality of reinforcement panels, the reinforcement flaps operating to reinforce the two of the plurality of reinforcement panels.

In still another embodiment of the carrier of the present invention, a detachable coupon-like portion can be provided in the reinforcement panels

BRIEF DESCRIPTION OF THE DRAWINGS

A more complete understanding of the present invention may be obtained from consideration of the following detailed description in conjunction with the accompanying drawings in which.

DETAILED DESCRIPTION OF THE DRAWINGS

Figure 1:
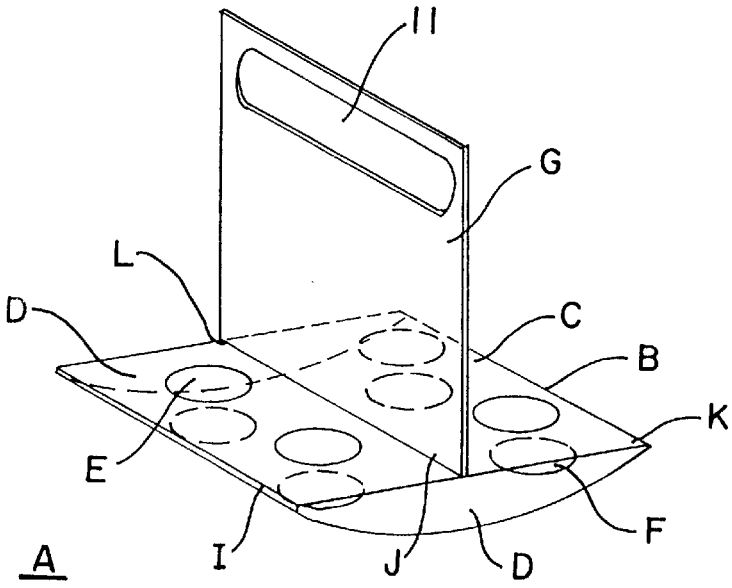
(PRIOR ART) FIG. 1
FIG. 1 shows a front plan view of a conventional prior art disposable food and beverage container carrier.
Figure 2B:
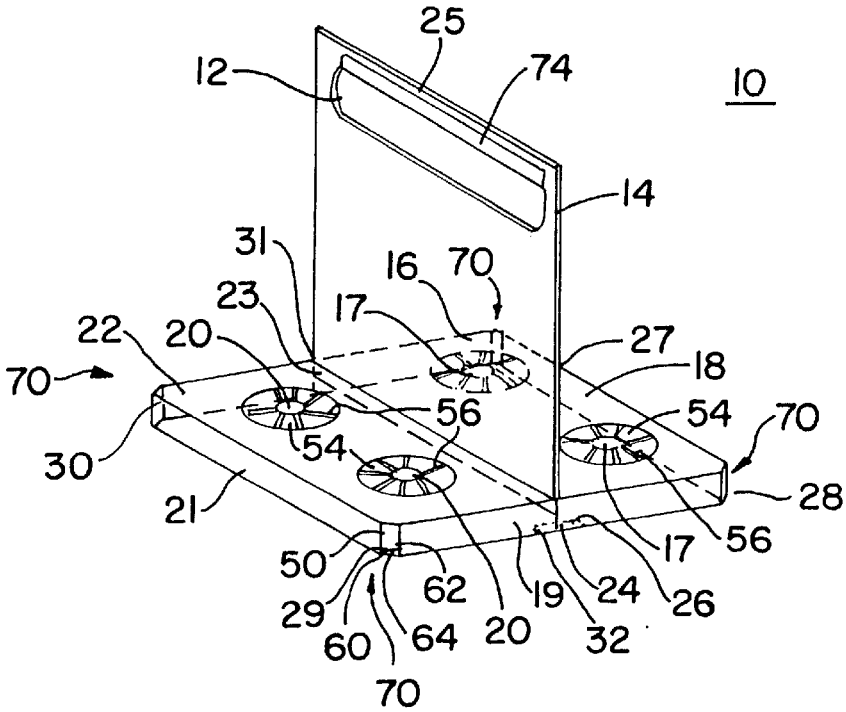
FIG. 2B shows a perspective side view of the food and beverage container carrier of the present invention assembled from the sheet shown in FIG. 2A.
Figure 2A:
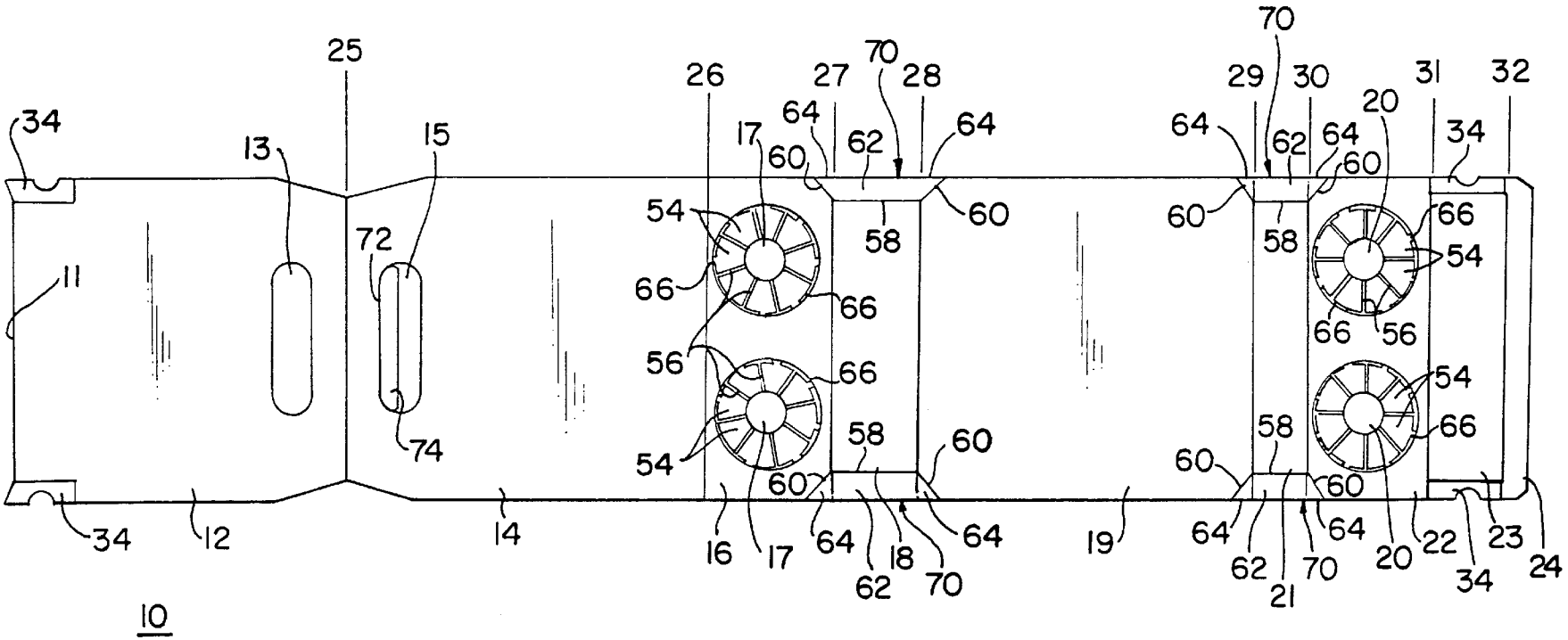
FIG. 2A shows a top plan view of a single sheet of material from which an exemplary embodiment of the disposable food and beverage container carrier according to the present invention is fabricated.

Referring collectively to FIGS. 2A and 2B, a disposable food and beverage container carrier 10 according to the present invention is shown and denoted by the numeral 10. FIG. 2A shows a single sheet 11 of cardboard or plastic from which the carrier 10, as shown in FIG. 2B, is assembled. The sheet 11 is generally divided by creases 25, 26, 27, 28, 29, 30 and 31 into nine panels 12, 14, 16, 18, 19, 21, 22 and 23. A crease 32 divides panel 23 and a reinforcement tab 24. Panels 18 and 21 each include a pair of creases 58 which extend parallel to the edges thereof. Panels 16, 19, and 22 each include a pair of creases 60 which extend at approximately a 45 degree angle from the edges of panels 16, 19, and 22 and meet associated creases 58 defined on panels 18 and 21. The creases, 58 and 60 define selectively re-useable, reinforcement flaps 70 which reinforce panels 18 and 21. Each reinforcement flap 70 includes a rectangular shaped folding center portion 62 and two triangular shaped folding end portions 64. Reinforcement flaps 70 can be repeatedly engaged and disengaged. In addition, panels 12 and 23 each include selectively moveable vertical reinforcement tabs 34 which provide additional rigidity and strength to carrier 10. Tabs 34 can be moved through an angle of approximately 180 degrees.

When the sheet 11 shown in FIG. 2A is assembled into the carrier 10 of FIG. 2B, the panels 12 and 14, which each define an elongated finger opening 13 and 15, will form the handle of the carrier 10. The finger opening 15 optionally includes a tab 74 which folds into finger opening 13 to strengthening the handle of the carrier 10. The panels 16, 18, 19, 21, 22, 23, and tab 24 will form the container support tray of the carrier 10. In particular, the panels 16 and 22 will form the upper container support wall of the container support tray and panel 19 will form the lower container support wall of the container support tray. The panels 16 and 22 define respective container apertures 17 and 20. The panels 18, 21, 23, and 24 operate as reinforcement panels to add rigidity to the container support tray made up of panels 16, 22, and 19 and thus, substantially prevent the support tray from collapsing, tearing, or falling apart.

Figure 4:
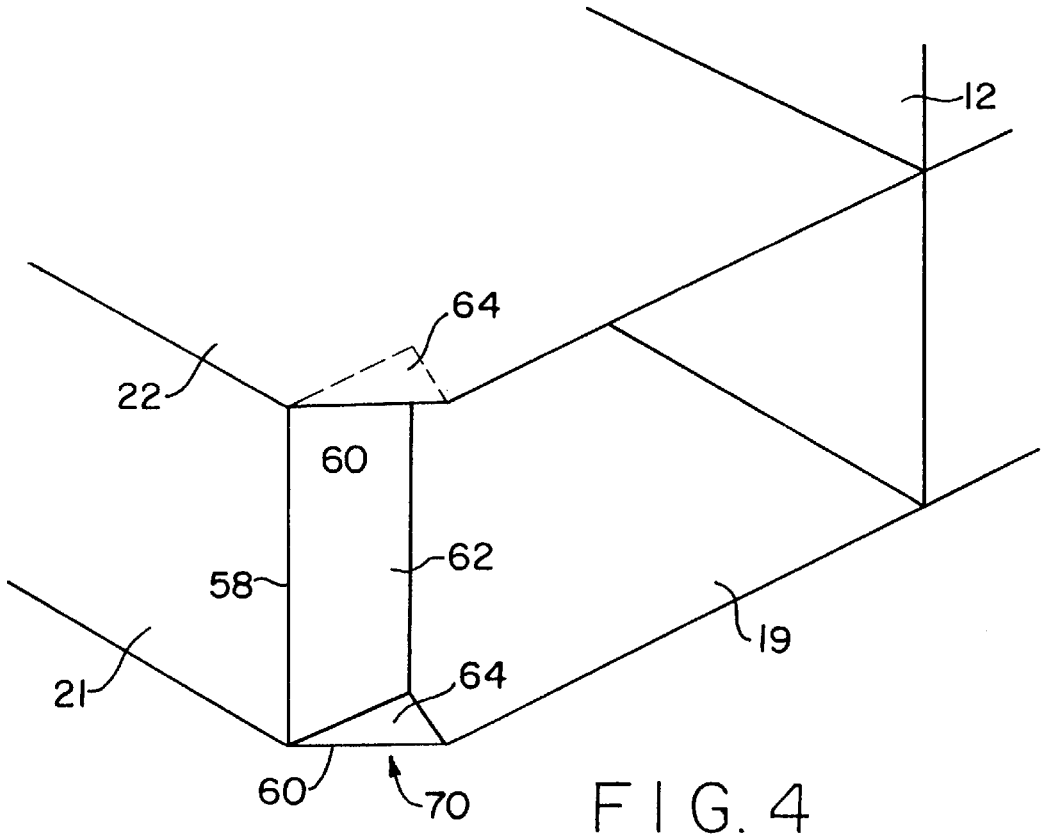
FIG. 4 shows an enlarged view of one of the reinforcement flaps used in the food and beverage container carrier of the present invention.

To add further rigidity to the carrier, each reinforcement flap 70 is folded into the space defined between the upper and lower container support walls as shown in the enlarged view of FIG. 4, with the triangular-shaped folding end portions 64 operating to lock the folding center portion 62 between the upper and lower container support walls. Once folded, the folding center portion 62 operates as a brace to provide additional rigidity to the reinforcement panels 18 and 21.

Figure 5:
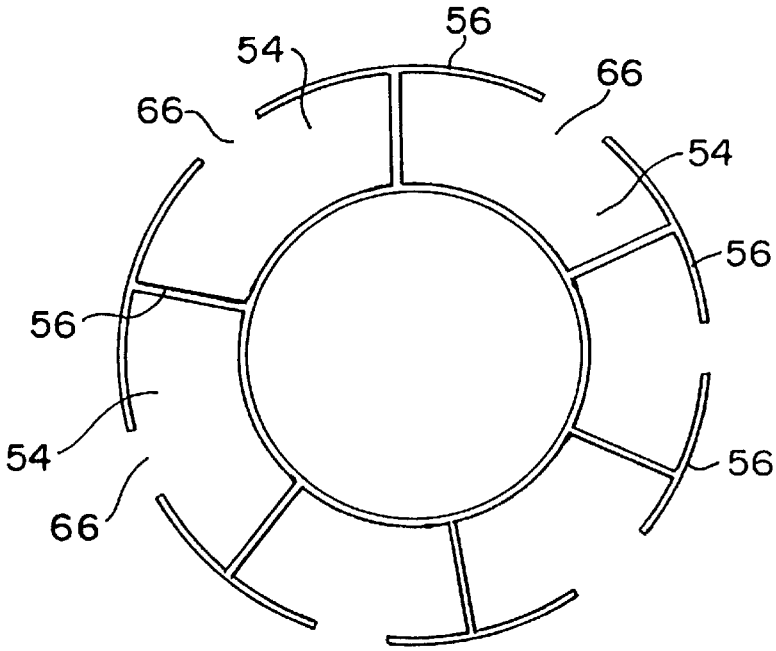
FIG. 5 shown an enlarged view of one of apertures having the container gripping means of the present invention.

In the embodiment shown in FIGS. 2A and 2B, the apertures 17 and 20 in the upper container support wall defined by panels 16 and 22 include container gripping means formed by a plurality of individual tabs 54 which extend radially inward from the perimeter of each aperture. As best seen in FIG. 5, the tabs 54 are separated by T-shaped cut lines 56 which extend along the sides of the tabs and partially along the perimeter of the apertures. Each tab 54 is coupled to its respective panel along the perimeter of the aperture by a flexible hinge 66 which is disposed between each pair of T-shaped cut lines 56. The tabs 54 bend down into the aperture when a container is inserted into the aperture. The free edges of the tabs 54 grip the surface of the container to help prevent the container from slipping out of the aperture.

The carrier 10 is assembled from the sheet 11 as follows. First, the panel 12 is folded against panel 14 along crease 25 to form the vertically extending carrying handle for the carrier 10. Next, the panel 16 is perpendicularly folded upwards in relation to the folded together panels 14 and 12 along crease 26 to form one half of the upper container support wall of the carrier 10. The carrier reinforcement panel 18 is then folded perpendicularly in relation to the panel 16 along crease 27. Then, the panel 19 is folded perpendicularly relative to the carrier reinforcement panel 18 along crease 28. Next, the carrier reinforcement panel 21 is folded perpendicularly relative to the panel 19 and the crease 29. The panel 22 is then folded perpendicularly relative to the carrier reinforcement panel 21 along the crease 30. The carrier reinforcement panel 23 is then folded perpendicularly downwards relative to the panel 22 along the crease 31 to form the second half of the upper container support wall of the carrier 10. The, carrier reinforcement tab 24 is folded perpendicularly upwards relative to the carrier reinforcement panel 23 along crease 32 such that carrier reinforcement panel 23 is vertically positioned, like carrier reinforcement panels 18 and 21, between the upper and lower container support walls of the carrier 10 and carrier reinforcement tab 24 is horizontally positioned along the interior surface of the lower container support wall, thereby providing additional rigidity to the container support tray of the carrier 10. Finally, the reinforcement flaps 70 Can be folded inwardly at each corner of the carrier 10.

The panels of the assembled carrier 10 are maintained in a folded manner by any well known pressure sensitive adhesive such as glue or any similar substance. The carrier 10 can be fabricated to have any desired number of container apertures. Additionally, the container apertures can be of any desired size or mix of sizes, and can be any desired shape such as circular, square, rectangular or the like, depending upon the type of food and beverage container to be carried therein.

Figure 3:
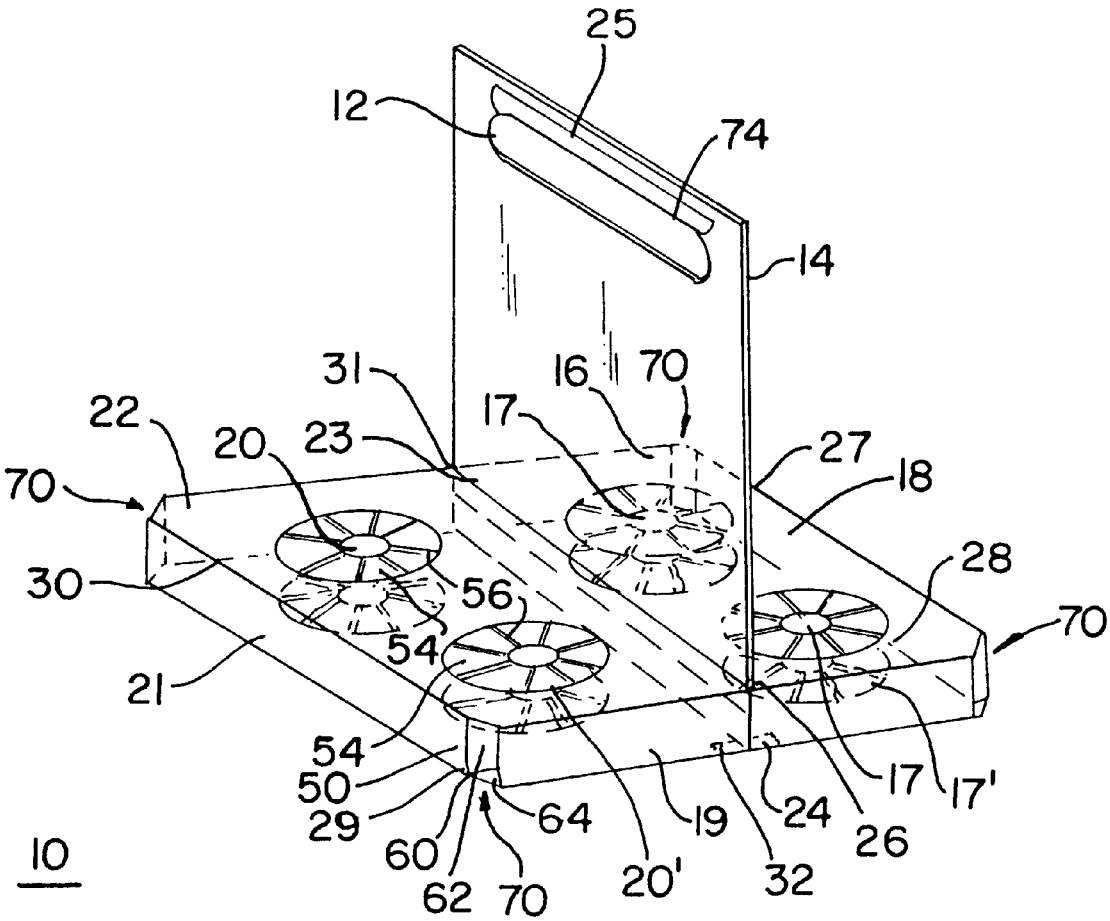
FIG. 3 shows a perspective side view of a second embodiment of the food and beverage container carrier of the present invention.

FIG. 3 shows a perspective side view of a second embodiment of the carrier of the present invention. The carrier shown in FIG. 3 differs from the embodiment of FIGS. 2A and 2B described above in that it additionally includes apertures 17'and 20' in the panel 19 which forms the lower container support wall of the carrier. Each of the apertures 17' and 20' include the container gripping means formed by a plurality of individual tabs 54 which extend radially inward from the perimeter of each aperture as described previously with respect to the first embodiment of FIGS. 2A and 2B and shown in FIG. 5.

Figure 6A:
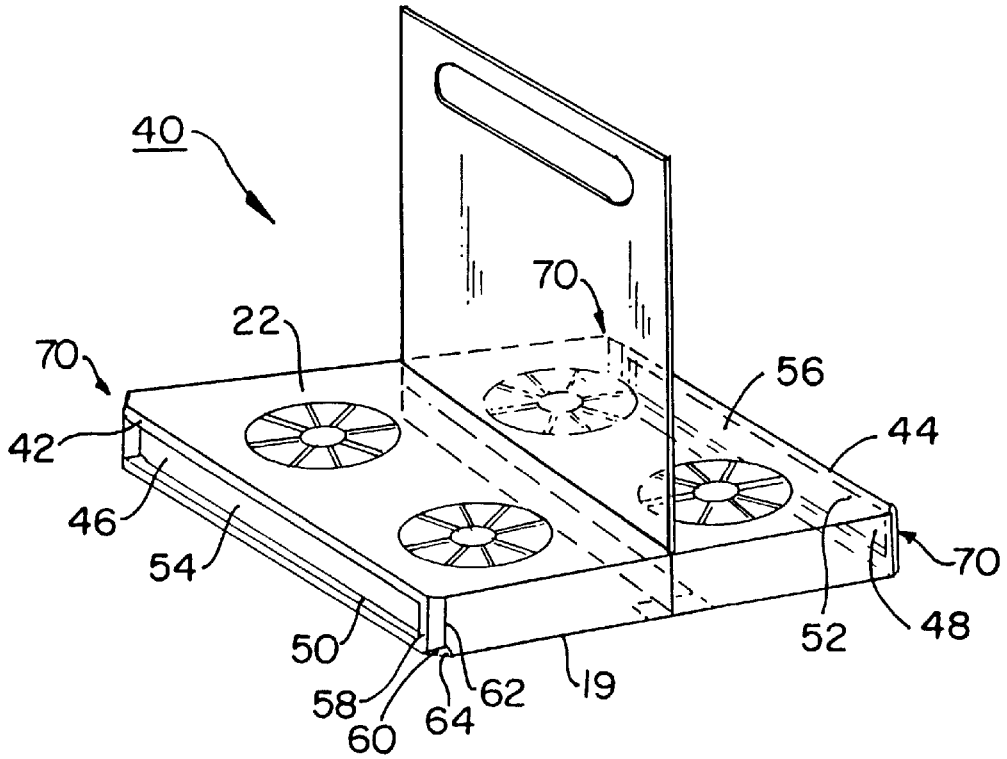
FIG. 6A shows a perspective side view of a third embodiment of the food and beverage container carrier of the present invention.
Figure 6B:
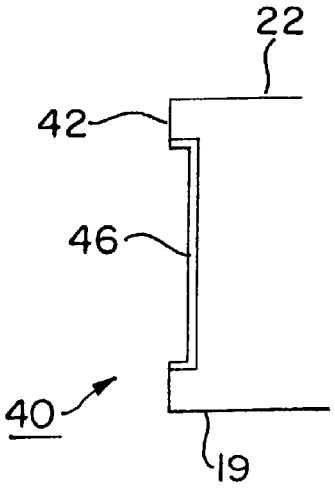
FIG. 6B shows a side view of one of the reinforcement panels and the recessed panel therein of the food and beverage container carrier shown in FIG. 6A.

FIG. 6A shows a perspective side view of a third embodiment of the carrier denoted by the numeral 40. The carrier 40 only differs from the first embodiment described above and shown in FIGS. 2A and 2B, by the inclusion of a panels 46 and 48 which are defined in the carrier reinforcement panels 42 and 44, respectively. The panels 46 and 48 can be, but need not be, recessed. Recessed panels 46 and 48 are fabricated in such a manner as to add more rigidity to the panels 42 and 44, such as by being of a greater thickness than panels 42 and 44 as shown in FIG. 6B, thereby strengthening panels 42 and 44, and carrier 40. The panels 46 and 48 can be used to advertise goods and/or services by the inclusion of indicia 54, 56 thereon. In addition, and as shown in FIG. 6A, panels 46 and 48 can each be perforated along their respective borders 50 and 52 to allow the panels 46 and 48 to be easily torn from the carrier 40 and used as purchasing coupons or the like. In all embodiments of the present invention, the panels forming the upper container support wall and handle of the carrier can also include advertising or other descriptive markings thereon including detachable coupons as described above. In addition, conventional carrying rests can be provided above the panels which form the upper container support wall.

In other embodiments of the present invention, the reinforcement panels 18 and 21 can be used to advertise goods and/or services by the inclusion of indicia thereon. In still other embodiments of the present invention, the creases 27, 28, 29, 30, 58, and 60 can be perforated to allow the panels 18 and 21 to be easily torn from the carrier 10 and used as purchasing coupons or the like.

One of ordinary skill in the art will recognize that other embodiments of the carrier can selectively include and mix as desired, the various features described herein such as the container gripping means, the reinforcement flaps, the recessed panels and the like in a single embodiment of the invention.

Accordingly, it will be understood that the embodiments described herein are merely exemplary and that a person skilled in the art may make many variations and modifications to the described embodiments utilizing functionally equivalent elements to those described. Any variations or modifications to the invention just described are intended to be included within the scope of the invention.

What is claimed is:

1. A carrier for transporting food and beverage containers, comprising:

a first container support wall for supporting an upper portion of a food and beverage container;

a second container support wall for supporting a lower portion of a food and beverage container;

at least one aperture disposed in said first container support wall for enabling said carrier to receive a food and beverage container;

a plurality of reinforcement panels extending between said first and second container support walls for rigidifying said carrier, each of said reinforcement panels defining a pair of opposing edges, wherein at least one of said reinforcement panels is coupled to a reinforcement tab that has a side surface which is adhesively coupled to the interior of one of said first and second container support walls; and selectively re-usable reinforcement flaps extending along said edges of two of said plurality of reinforcement panels, said reinforcement flaps operating to reinforce said two of said plurality of reinforcement panels, and wherein at least another one of said plurality of reinforcement panels includes selectively moveable vertical reinforcement tabs to reinforce said carrier.

2. The carrier according to claim 1, wherein said at least one aperture includes gripping means for gripping said container.

3. The carrier according to claim 2, wherein said at least one aperture comprises a first plurality of apertures disposed in said first container support wall and said second container support wall having a second plurality of apertures disposed therein, said first and second plurality of apertures for enabling said carrier to receive a food and beverage container.

4. The carrier according to claim 3, wherein each of said apertures includes gripping means for gripping said container.

5. The carrier according to claim 1, wherein said at least one aperture includes gripping means for gripping said container.

6. The carrier according to claim 1, wherein said at least one aperture comprises a first plurality of apertures disposed in said first container support wall and said second container support wall having a second plurality of apertures disposed therein, said first and second plurality of apertures for enabling said carrier to receive a food and beverage container.

7. The carrier according to claim 6, wherein each of said apertures includes gripping means for gripping said container.

8. The carrier according to claim 2, wherein at least one of said reinforcement panels includes a recessed panel portion therein.

9. The carrier according to claim 8, wherein said recessed panel portion includes indicia.

10. The carrier according to claim 9, wherein said recessed panel portion includes a perforated perimeter which enables said recessed panel portion to be easily removed from said reinforcement panel.

11. The carrier according to claim 10, wherein said recessed panel portion having said perforated perimeter and including indicia thereon is a purchasing coupon.

12. The carrier according to claim 1, wherein at least one of said reinforcement panels includes a recessed panel portion therein.

13. The carrier according to claim 12, wherein said recessed panel portion includes indicia.

14. The carrier according to claim 13, wherein said recessed panel portion includes a perforated perimeter which enables said recessed panel portion to be easily removed from said reinforcement panel.

15. The carrier according to claim 14, wherein said recessed panel portion having said perforated perimeter and including indicia thereon is a purchasing coupon.

16. The carrier according to claim 2, wherein at least one of said reinforcement panels includes indicia.

17. The carrier according to claim 16, wherein said at least one of said reinforcement panels having said indicia includes perforations surrounding said indicia, said perforations enabling said indicia to be easily removed from said at least one of said reinforcement panels having said indicia.

18. The carrier according to claim 17, wherein said indicia is a purchasing coupon.

19. The carrier according to claim 1, wherein at least one of said reinforcement panels includes indicia.

20. The carrier according to claim 19, wherein said at least one of said reinforcement panels having said indicia includes perforations which enables said at least one of said reinforcement panels having said indicia to be easily removed from between said first and second container support walls.

21. The carrier according to claim 20, wherein said at least one of said reinforcement panels having said indicia is a purchasing coupon.

22. The carrier according to claim 1, further comprising means for carrying said carrier, wherein said carrying means extends from said first container support wall.

23. The carrier according to claim 22, wherein said carrying means comprises a handle.

24. The carrier according to claim 23, wherein said handle includes indicia.

* * * * *